US005154839A

United States Patent [19]

Hanano

[11] Patent Number: 5,154,839

[45] **Date of Patent: * Oct. 13, 1992**

[54] POWDER LUBRICANT FOR PLUNGER DEVICE

[75] Inventor: Takashi Hanano, Kobe, Japan

[73] Assignee: Hanano Commercial Co., Ltd, Kobe, Japan

[ * ] Notice: The portion of the term of this patent subsequent to Aug. 13, 2008 has been disclaimed.

[21] Appl. No.: 675,767

[22] Filed: Mar. 27, 1991

[30] Foreign Application Priority Data

Jan. 17, 1991 [JP] Japan ..... 3-18450

[51] Int. Cl.[5] ..... C10M 125/10; B22C 3/00

[52] U.S. Cl. ..... 252/18; 252/20; 252/22; 106/38.22; 106/38.24

[58] Field of Search ..... 252/18, 20, 22

[56] References Cited

U.S. PATENT DOCUMENTS 4,787,993 6/1991 Nagahiro ..... 252/18

5,039,435 8/1991 Hanano ..... 106/38.22

FOREIGN PATENT DOCUMENTS 2003923 3/1979 United Kingdom ..... 252/18

*Primary Examiner*—Brian E. Hearn
*Assistant Examiner*—Maria Nuzzolillo
*Attorney, Agent, or Firm*—Armstrong & Kubovcik

[57] ABSTRACT

The powder lubricant for plunger device of this invention is a mixture of a powdered or granulated lubricant base material used for a lubricant in a solid form, with an organic compound giving an adhesion ability to the lubricant base material. The most outstanding feature of this invention is that the lubricant base material has the powdered or granulated form. Effect of this invention are that occurrence of defects inside products can be positively avoided, dangers such as fire etc. and environmental pollution can be prevented, and sliding of plunger can be made smooth to improve the workability.

5 Claims, 1 Drawing Sheet

POWDER LUBRICANT FOR PLUNGER DEVICE

BACKGROUND ART

Industrial Useful Field

This invention relates to a lubricant used for being blown onto a plunger tip surface or a sleeve inside face of plunger device for a diecasting machine for use in diecasting work.

PRIOR ART

As shown in FIG. 1, a plunger device 1 is a device for filling molten metal into dies in diecasting work, and is composed of a sleeve 11 connecting into a stationary-side die 2 and a plunger tip 12 sliding in the sleeve 11 to extrude a molten metal which is supplied from a filling port 11a, into the die. 3 is a moving-side die.

The diecasting method is one allowing continuous and massive manufacturing of diecasting products with a high accuracy, so that it is widely utilized for manufacturing various parts of automobiles, electrical components, household goods and building materials etc. In this diecasting method, the molten metal is extruded into the die for molding at a high speed by the plunger device. In order to permit the plunger tip in the sleeve to slide smoothly and to prevent its wear in this instance, a lubricant for the plunger device is used. Lubricants for the plunger device are generally classified into oily lubricants and water soluble lubricants. Both lubricants include a mineral oil, a natural fat, a wax and a synthetic lubricating oil etc. as their base. An extreme-pressure agent and an abrasion resisting lubricant are added to the oily lubricant, and water and a surface active agent are added to the water soluble lubricant.

Problems To Be Solved By The Invention

In recent years, demands for improving the quality of diecasting products such as decreases in cost, a lessening of the defective fraction and a reduction in weight etc. have grown with the progress of diecasting technology and the improvement in alloys. Such demands can not be satisfied by conventional lubricants for plunger devices.

In both oily lubricants and water soluble lubricants, defects have occurred inside the diecast products due to generated gas, so that problems such as a weakening of pressure resisting strength due to the reduction in weight and a failure to cope with a higher working cycle have arisen. The water soluble lubricants have included such problems that there has been a high possibility of occurrence of defects inside the products due to residual water, and various costs such as capital investment have been required because of necessary waste water treatment due to prevention of water pollution after use. The oily lubricants have included such problems as being inferior in safety due to a high possibility of smoking and inflammability and contamination of the working environment. Consequently, a strong demand for a lubricant for a plunger device of new type has increased.

This invention has been made, in consideration of the above-mentioned circumstances, by earnest studies and various systematic experiments. An object of this invention is to provide a powder lubricant for a plunger device useful for producing cast products of high quality by the diecasting method without worsening environmental conditions and with good workability; and, in detail, a powder lubricant for a plunger device which can positively prevent an occurrence of inside defects, in the product can avoid the danger of fire and the pollution of the environment, and further allows the plunger tip to slide smoothly so as to improve the workability.

SUMMARY OF THE INVENTION

Figure 1:
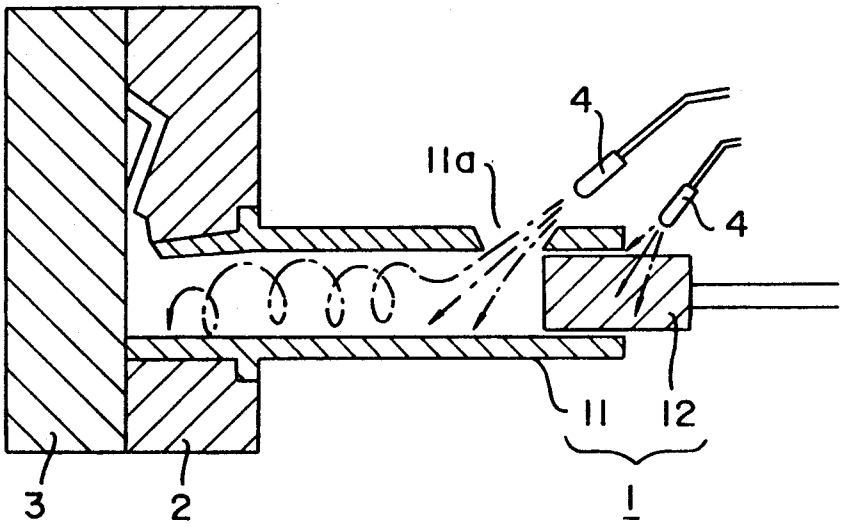
FIG. 1 is a sectional view showing a sprayed state of the lubricant of this invention onto the plunger device.

The powder lubricant for a plunger device of this invention consists essentially of a granulated or powdery mixture of a lubricant base material selected from the group consisting of boron nitride, fluoride, talc, mica, metal oxides, silicon nitride, boron compound, sulfur compound, phosphorus compound, molybdenum disulfide and graphite; an organic polymer selected from the group consisting of polyethylene, polypropylene, epoxy resin, silicon resin, natural wax, phenol resin, acrylic resin, alkyd resin, polyurethane resin and polystyrene resin; and a metal soap; wherein the lubricant base material is coated with the organic polymer or the metal soap. Moreover the lubricant may include a liquid-form or paste-form compound which is powdered or granulated by a cyclodextrin compound and is selected from the group consisting of synthesis esters, natural fats, mineral oils, silicon oil, polyphenyl ether, polyalkylene glycol and ethylene-propylene copolymer. Such a lubricant is used by being sprayed onto a surface of the plunger tip 12 or an inside face of the sleeve 11 through the filling port 11a by means of an ordinary spray system or an electrostatic spray system, as illustrated by FIG. 1. Numeral 4 is a nozzle used for spraying.

In the powder lubricant for a plunger device of this invention, the lubricant base material has at least the powdered or granulated form so that it is difficult to react and scarcely generates gas even when heat is applied thereto. For this reason, blow holes due to gas are not produced inside the product. Further, the lubricant of this invention is composed of the lubricant base material and organic compound, so that it does not have a water content and a substance having a low molecular weight. Accordingly, the occurrence of defects inside the products can be avoided and the quality the products can be improved.

Since the lubricant of this invention has the powdered or granulated form and does not include water, it does not contaminate the water quality after use as in case of water soluble lubricants and it does not contaminate the working environment as in case of oily lubricants. For this reason, the expense for waste water treatment and the expense for prevention of worsening of the environment will become unnecessary. Further, the lubricant of this invention does not include oily substances so that there exists no danger of smoking and fire and no problem in safety.

In the powder lubricant of this invention, the lubricant base material has at least the powdered or granulated form so that the plunger tip is positively separated from the sleeve by at least a space corresponding to a the grain size of the powder or the granule of the lubricant base material in the vicinity of the plunger tip surface and the inside face of the sleeve to which the lubricant is adhered. Accordingly, the plunger tip is prevented from contacting the sleeve, temperature adhesion and abrasion at the time of sliding can be avoided, the sliding motion becomes smooth, and the workability can be improved.

DETAILED DESCRIPTION OF THE INVENTION

The most outstanding feature of this invention is that the lubricant base material has the powdered or granulated form.

It is effective to select a contained amount of organic compound to lubricant base material to a value in a weight percent range of 0.1 to 50. This is because a sufficient adhesion effect of the lubricant base material to the plunger tip surface or to the inside face of the sleeve can not be attained when this value is smaller than 0.1 weight percent, and defects inside the products due to generation of gas would be produced when this value is larger than 50 weight percent.

There is no special limitation as to the lubricant base material usable in this invention so long as it can be used for the lubricant in the solid form. Generally, boron nitride, fluoride, talc, mica, metal oxides, silicon nitride, boron compound, sulfur compound and phosphorus compound etc. are preferably used for the lubricant base material. However, well-known solid lubricants used previously for lubricants such as graphite, molybdenum disulfide etc. may also be used therefor. These lubricant base materials may be used alone or by combining two or more kinds, in the powdered or granulated form.

There is no special limitation to the organic compound usable in this invention so long as it is the above-mentioned lubricant base material provided with the adhesion ability or the sticking ability. Generally, metallic soap, high-molecular compound and liquid-form or paste-form compounds which are powdered or granulated by cyclodextrin compound, are preferably used for the organic compound. Carboxylic acid skeleton added with sodium, calcium, aluminium, barium, lithium, potassium, magnesium or zinc, is preferably used for the metal soap. Polyethylene, polypropylene, epoxy resin, silicon resin, natural wax, phenol resin, acrylic resin, alkyd resin, polyurethane resin or polystyrene resin is preferably used for the high-molecular compound. Synthesis esters, natural fats,, mineral fats, silicon oil, polyphenyl ether, polyalkylene glycol, or ethylene-propylene copolymer are preferably used for the liquid-form or paste-form compound. These organic compounds are mixed with the lubricant base material in the form of powder or granule, or mixed with the lubricant base material in the heated and molten state. Accordingly, in the lubricant of this invention, both the lubricant base material and the organic compound have the powdered or granulated form, or the powdered or granulated lubricant base material is covered by the organic compound. These organic compounds may be used alone or by combining two or more kinds of the above-mentioned compounds. The metal soap, high-molecular compound, and powdered liquid-form or paste-form compound may be combined and used.

Effect of the Invention

According to the present invention, the powder lubricant for a plunger device comprising the mixture of the lubricant base material with the organic compound is made into the form that at least the lubricant base material has the powdered or granulated form. As a consequence the occurrence of defects inside diecast product an aluminum alloy, a zinc alloy etc. produced by the diecasting method can be positively avoided so as to improve its quality, the workability the diecasting work can be improved by the diecasting method, and further the contamination of environment during and after use can be fully prevented.

Especially, since the contained amount of organic compound to lubricant base material is preset to the weight percent range of 0.1 to 50, the quality of diecast products produced can be enhanced. Further, the following materials are used for the lubricant base material: boron nitride, fluoride, talc, mica, metal oxide, silicon nitride, boron compound, sulfur compound and phosphorus compound. The following materials are used for the organic compound: metal soap comprising a carboxylic acid skeleton combined with sodium, calcium, aluminium, barium, lithium, potassium, magnesium or zinc; a high-molecular compound such as polyethylene, polypropylene, epoxy resin, silicon resin, natural wax, phenol resin, acrylic resin, alkyd resin, polyurethane resin or polystyrene resin; or materials in which liquid-form or paste-form compounds such as synthesis esters, natural fats, mineral fats, silicon oil, polyphenyl ether, polyalkylene glycol, or ethylene-propylene copolymer are powdered or granulated by cyclodextrin compound. Therefore, the above-mentioned effects can be accomplished. A lubricant optimum for use in the diecasting work can be obtained by combining two or more kinds respectively from among the above-mentioned organic compounds and lubricant base materials.

Embodiments

Embodiments of this invention are described hereunder, but this invention is not limited only to them.

The following lubricants (A) to (F) were prepared, an aluminium alloy was cast by the diecasting method using these lubricants, and items listed in The Table were compared and examined.

Two kinds of materials to be mixed for embodiments (A) to (D) of this invention were prepared: one in which an organic compound to be used was mixed with lubricant base material in the form of powder or granule, and another in which the organic compound to be used was mixed with lubricant base material in the heated and molten state. Both were examined and the results were the same. An organic compound, in which natural fat was powdered by an experimental method using cyclodextrin compound, was used for the organic compound (D) but other compounds were purchased from the market.

The lubricants prepared were:

(A): First embodiment of this invention composed of a mixture of 90 parts of mica (mean particle size; 6 microns) and 10 parts of polyethylene;

(B): Second embodiment of this invention composed of a mixture of 10 parts of boron nitride, 60 parts of mica and 30 parts of calcium stearate;

(C): Third embodiment of this invention composed of a mixture of 70 parts of talc, 10 parts of silicon nitride, 10 parts of natural wax, and 10 parts of zinc stearate;

(D): Fourth embodiment of this invention composed of a mixture of 20 parts of boron nitride, 60 parts of talc, 5 parts of sodium borate, and 15 parts of powdered natural fat;

(E): Boron nitride only (comparative example 1);

(F): Oily lubricant for plunger device available commercially composed of mineral oil, natural oil and a wear resisting agent (comparative example 2).

TABLE

| | This invntion | | | | Example | |
|---|---|---|---|---|---|---|
| | (A) | (B) | (C) | (D) | (E) | (F) |
| Adhesion ability | ◎ | ◎ | ◎ | ◎ | x | ◎ |
| Expansion ability | ○ | ○ | ◎ | ◎ | — | ◎ |
| Lubrication ability | ◎ | ◎ | ◎ | ◎ | — | ○ |
| Effect for preventing occurrence of defects in product | ◎ | ◎ | ◎ | ◎ | — | Δ |
| Effect of preventing environmental pollution in field due to smoking and contamination | ◎ | ◎ | ◎ | ◎ | — | Δ |

—: Unmeasurable
x: None observed
Δ: Low
○: Medium
◎: High

What is claimed is:

1. A powder lubricant for a plunger device consisting essentially of a granulated or powdery mixture of a lubricant base material selected from the group consisting of boron nitride, fluorides, talc, mica, metal oxides, silicon nitride, boron compounds, sulfur compounds, phosphorus compounds, molybdenum disulfide and graphite; an organic polymer selected from the group consisting of polyethylene, polypropylene, epoxy resins, silicon resins, natural waxes, phenol resins, acrylic resins, alkyd resins, polyurethane resins and polystyrene resins; and a metal soap; wherein the lubricant base material is coated with the organic polymer or the metal soap.

2. A powder lubricant for a plunger device as set forth in claim 1, wherein the content of the organic polymer and the metal soap relative to the lubricant base material is 0.1 to 50 weight percent.

3. A powder lubricant for a plunger device consisting essentially of a granulated or powdery mixture of a lubricant base material selected from the group consisting of boron nitride, fluorides, talc mica, metal oxides, silicon nitride, boron compounds, sulfur compounds, phosphorus compounds, molybdenum disulfide and graphite; an organic polymer selected from the group consisting of polyethylene, polypropylene, epoxy resins, silicon resins, natural waxes, phenol resins, acrylic resins, alkyd resins, polyurethane resins and polystyrene resins; a metal soap; and a liquid-form or paste-form compound which is granulated or powdered buy a cyclodextrin compound, the liquid-form or paste-form compound selected from the group consisting of synthesis esters, natural fats, mineral oils, silicon oils, polyphenyl ethers, polyalkylene glycols and ethylene-propylene copolymers, wherein the lubricant base material is coated with the organic polymer or the metal soap or the liquid-form or paste-form compound.

4. A powder lubricant for a plunger device as set forth in claim 3, wherein the content of the organic polymer, the metal soap and the liquid-form or paste-form compound relative to the lubricant base material is 0.1 to 50 weight percent.

5. A powder lubricant for plunger device as set forth in any one of claim 1 through claim 4, wherein the metal soap is selected from the group consisting of sodium, calcium, aluminium, barium, lithium, potassium, magnesium and zinc salts of carboxylic acids.

* * * * *